United States Patent [19]

Herron et al.

[11] 4,260,207

[45] Apr. 7, 1981

[54] LATCH FOR SEWING MACHINE COVER

[75] Inventors: William L. Herron, Elizabeth; Albert L. Newman, West Orange, both of N.J.

[73] Assignee: The Singer Company, Stamford, Conn.

[21] Appl. No.: 63,898

[22] Filed: Aug. 6, 1979

[51] Int. Cl.[3] ..... H01M 39/38; A47B 21/00

[52] U.S. Cl. ..... 312/208; 312/244; 312/284

[58] Field of Search ..... 312/208, 244, 284; 292/173, 337; 220/306

[56] References Cited

U.S. PATENT DOCUMENTS

| | | | |
|---|---|---|---|
| 3,162,406 | 12/1964 | Stanton et al. | 312/208 |
| 3,563,675 | 2/1971 | Zilg et al. | 312/208 |
| 3,858,954 | 1/1975 | Hetterich | 312/208 |

*Primary Examiner*—Casmir A. Nunberg

*Attorney, Agent, or Firm*—Elliot A. Lackenbach; Robert E. Smith; Edward L. Bell

[57] ABSTRACT

An open bottomed sewing machine cover is tapered and slabbed at one end and provided with novel and improved latch means for use with platform beds, bed frames or bottom bed covers that are indented on the bottom at the ends to accept the latches which of comprises latch levers suspended on leaf springs adjacent the bottom edges of the open bottom provided with inward facing paddles at their lower extremities adapted to be pulled outwardly while the case is lowered over the machine to rest on the table top or over the major portion of a similar case cover for stacking and nesting and after the cover is lowered over a machine as the latch lever is released, the paddles move inward into indents provided adjacent the bottom of the machine to extend beneath the machine to support the machine for carrying.

6 Claims, 6 Drawing Figures

LATCH FOR SEWING MACHINE COVER

BACKGROUND OF THE INVENTION

Field of the Invention:

This invention relates to sewing machines and to covers therefore and, more particularly, to latches for affixing a cover to a sewing machine bed frame or bed cover to provide a carrying case combination therewith.

BACKGROUND OF THE INVENTION

Sewing machines have often been provided with carrying cases to protect the sewing machine during periods of nonuse and as a aid in the handling, transportation and storage thereof. Simple covers, both flexible and rigid, have also been heretofore utilized to provide a degree of protection for the machine during periods of nonuse. When true portability is desired, it has been heretofore known to provide the carrying case in two portions; a bottom portion to which the sewing machine is generally permanently attached and which extends beyond the sewing machine bed and a cover portion adapted to fit over the sewing machine and abut the top surface of the carrying case bottom portion. Latches of various types, especially those utilizing toggle clamps, have then been generally utilized to lock together the carrying case cover with the carrying case base.

In Tarle, U.S. Pat. Nos. 2,856,726 dated Oct. 21, 1958 and 2,966,377 dated Dec. 27, 1960 there are disclosed carrying cases wherein the case cover totally encloses the carrying case base and latch means are provided having oppositely directed inwardly projecting latch bolts on each end of the covers which engage mating apertures provided in the carrying case base portions to receive the bolts to latch the carrying case cover with the carrying case base portion. The inwardly directed latch bolts and the associated operating mechanisms therefore, however, partially abstruct the interior of the case cover and preclude stacking or nesting of such covers for shipping and storage. Moreover, the latch mechanism is rather complex and, therefore, expensive to manufacture and the specialized carrying case base portion required to be mounted to the sewing machine bed further adds to the cost and expense of such cases.

OBJECTS OF THE INVENTION

Bearing in mind the foregoing, primary objects of the present invention are to provide novel and improved carrying case covers which are economical to manufacture, durable and effective in use, which may be nested and stacked one substantially within the other for shipping and storage, which do not require a specialized separate carrying case base portion to be affixed to the sewing machine for cooperation therewith, and which may cooperate with the sewing machine bed frame or bed cover for lifting the machine.

Other primary objects of the present invention, in addition to the foregoing objects, are the provision of novel and improved latches for sewing machine carrying case covers which are adapted to directly engage the sewing machine bed frame or bed cover generally comprising a part of the sewing machine furnished when the machine is originally sold or a simplified and inexpensive mounting bracket easily furnished with sewing machines as sold or easily added thereto subsequent to sale whereby the carrying case covers may be separately sold and be adapted to fit a large variety of sewing machines, and wherein a large variety of sewing machines may be made portable efficiently and economically.

Still another primary object of the present invention, in addition to each of the foregoing objects, is the provision of novel and improved latches for sewing machine carrying case covers which have latching portions or paddles projecting inwardly to engage the sewing machine bed, bed cover or platform support frame but which may yet be moved manually outwardly to enable the carrying case covers to be fitted over the machines and to be nested and stacked for shipping and storage.

The invention resides in the combination, construction, arrangement and disposition of the various component parts and elements incorporated in improved sewing machine carrying case covers and latches therefore in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention an open bottomed sewing machine cover is tapered and slabbed at one end and provided with novel and improved latch means for use with platform beds, bed frames or bottom bed covers that are indented on the bottom at the ends to accept the latch. The latches of the present invention comprise spring loaded latch levers suspended on leaf springs adjacent the bottom edges of the open bottom and provided with inward facing or inwardly extending paddles or tongue portions at their lower extremities that are adapted to be pulled outwardly while the case is lowered over the machine to rest on the table top or over the major portion of a similar case cover for stacking and nesting. The latch levers are spring loaded by the leaf springs so that, after the cover is lowered over a machine, as the latch lever is released the paddles move inward into indents provided adjacent the bottom of the machine platform bed or bottom bed cover to extend beneath the machine to support the machine for carrying.

DESCRIPTION OF THE DRAWING

While the specification concludes with claims particularly pointing out and distinctly claiming the subject matter which is regarded as forming the present invention, it is believed the invention will be better understood from the following detailed description taken in conjunction with the annexed drawing which discloses, illustrates and shows a preferred embodiment or modification of the present invention and what is presently considered and believed to be the best mode of practicing the principles thereof and wherein:

DETAILED DESCRIPTION OF THE INVENTION

Figure 1:
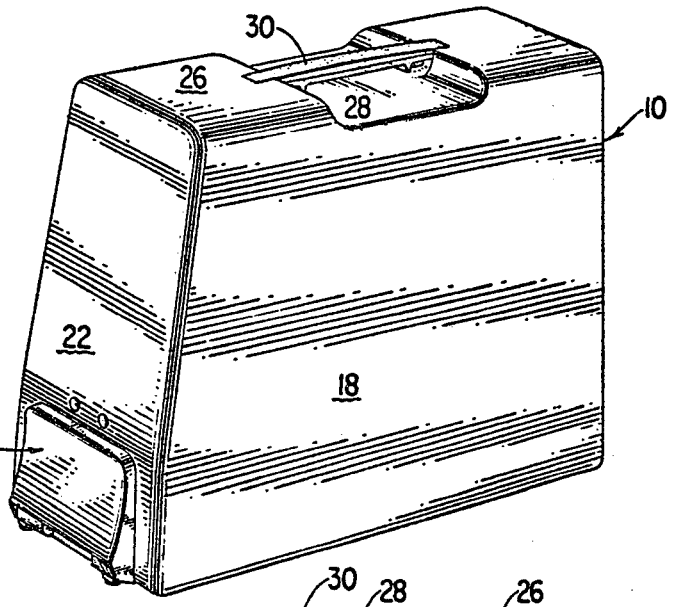
FIG. 1 is an isometric illustration of a sewing machine carrying case cover incorporating latches in accordance with the principles of the present invention.

With reference now to the drawing, there is shown and illustrated therein and designated generally by the reference character 10, and open bottomed carrying case cover for a sewing machine adapted to be engaged with a sewing machine to provide portability thereto. The carrying case cover 10 is specifically constructed and arranged to enable structural association thereof with a variety of different types of sewing machines and, for example, in FIG. 2 the carrying case cover 10 is illustrated in combination with a flat bed sewing machine designated generally by the reference character 12 and, more particularly, with a bed cover 14 associated therewith; while in FIGS. 3 though 6, inclusive, the carrying case cover 10 is shown and illustrated associated with a platform bed sewing machine 12' which has a platform bed of frame cover 14' extending longitudinally generally beneath a free arm or cylinder bed 16.

Figure 2:
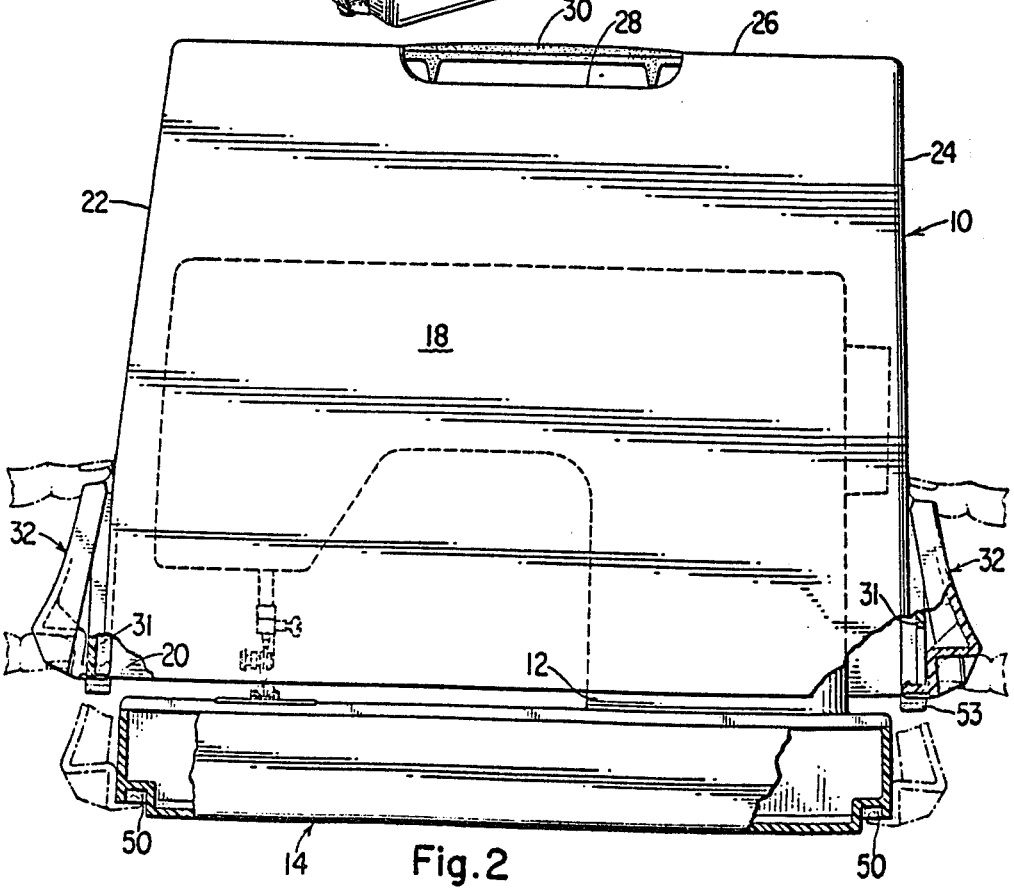
FIG. 2 is a side elevational view of the carrying case cover of FIG. 1 together with a flat bed sewing machine provided with a bed cover illustrating how the latches may be held out while the case cover is lowered over the machine and its bed cover and further indicating, in phantom, how the spring loaded latch levers, when released, engage the bed cover beneath the sewing machine.
Figures 3, 4:
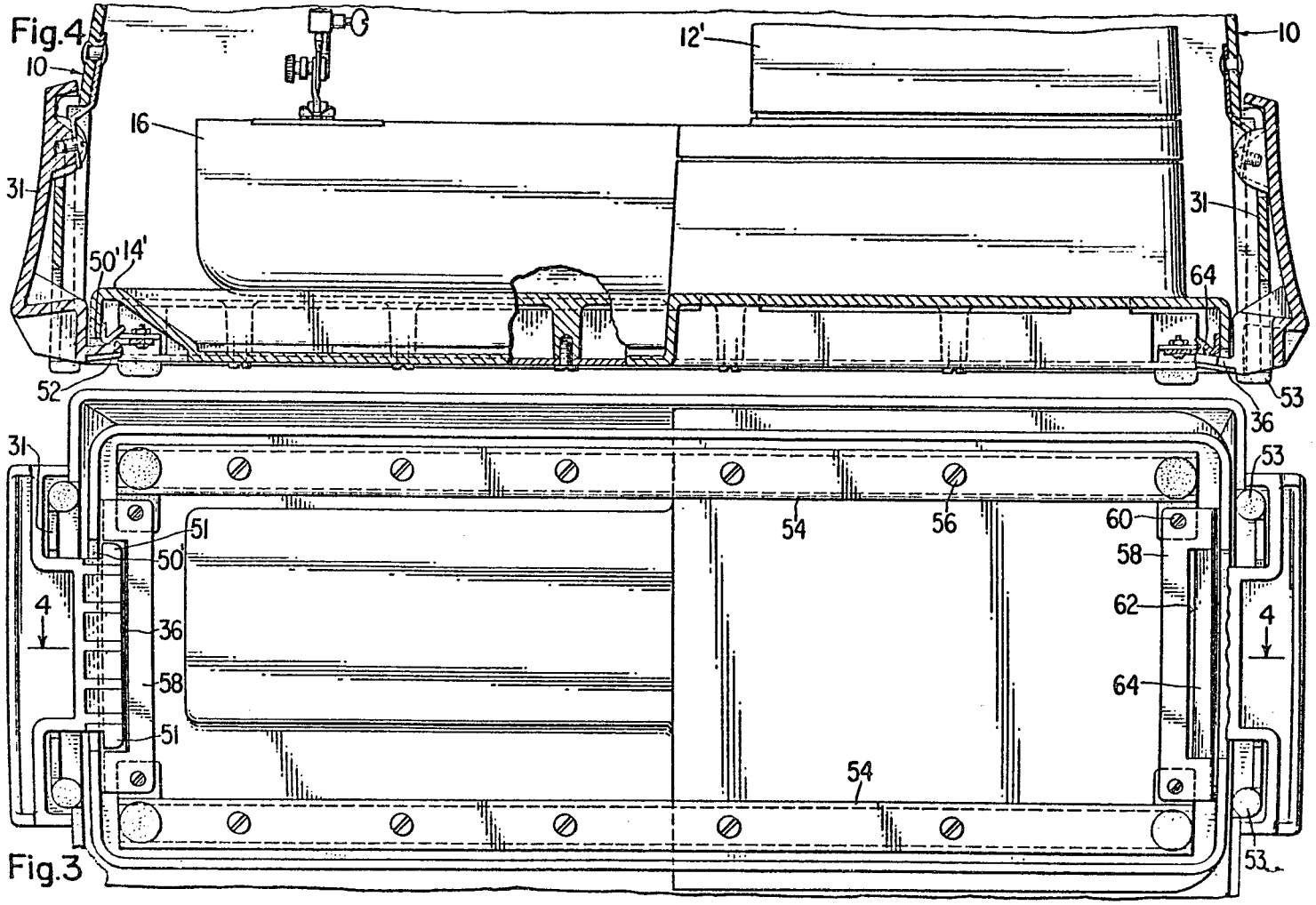
FIG. 3 is a bottom plan view of a platform bed sewing machine adapted to receive the carrying case cover and latches of the instant invention with the latched cover of the instant invention in place thereon with the illustration being partially broken away to show how the platform frame may be adapted to cooperate with the latch levers.
FIG. 4 is a partial elevational cross sectional view taken along line 4—4 of FIG. 3.
Figure 5:
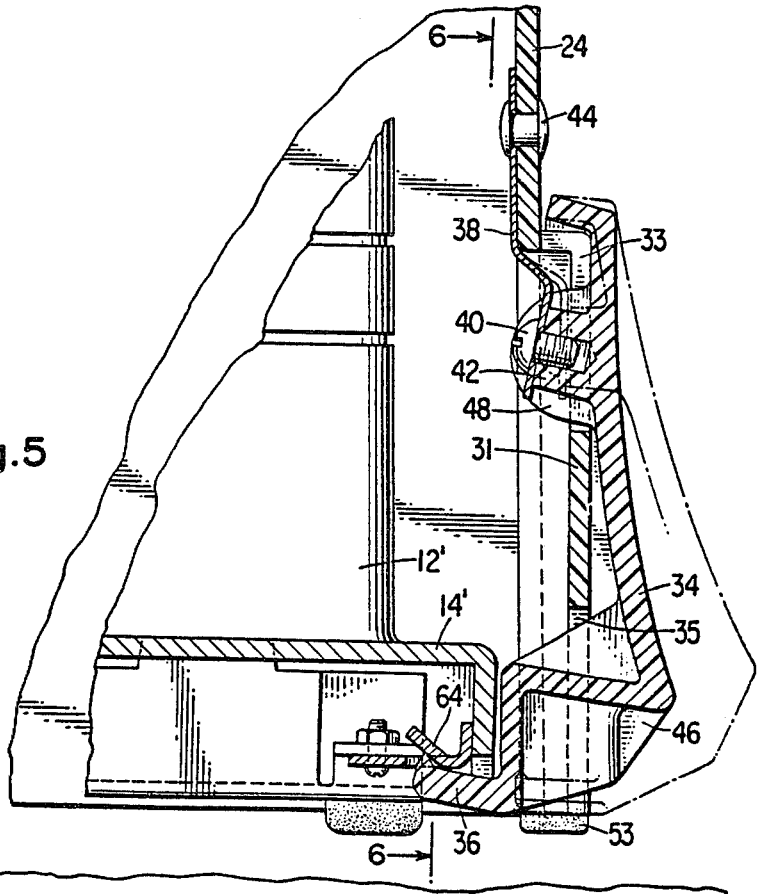
FIG. 5 is an enlarged partial cross sectional elevational view of the latch region.
Figure 6:
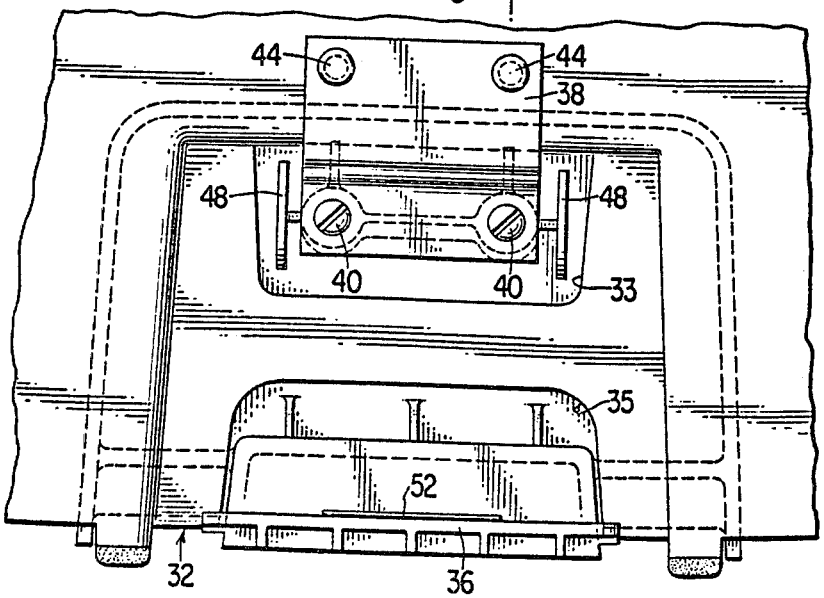
FIG. 6 is an elevational view of the latch viewed from inside the carrying case cover generally along the 6—6 in FIG. 5.

The carrying case cover 10 comprises a pair of side panels 18 and 20, a pair of end panels 22 and 24 and a top panel 26 provided with a recess 28 and a handle 30. The cover 10 is generally upwardly and inwardly tapered, with each of the wall panels sloping generally upwardly and inwardly and the end panel 22 is slabbed, as shown, so as to enable nesting of a plurality of the carrying case cover 10 for shipping and storage. Upon each of the end panels 22 and 24, there is provided a latch, designated generally by the reference character 32, and each of the latches 32 comprises an integrally molded combined handle portion 34 provided, at its lower end portion with an inwardly directed tongue or paddle portion 36. The end panels 22 and 24 are provided with raised portions 31 provided with apertures 33 spaced apart from the bottom edge of the cover 10 and slots 35 extending upwardly from the bottom edge of the cover 10 toward the apertures 33. The handles 34 are secured with the carrying case end panels 22 and 24 by means of leaf springs 38 secured generally adjacent the upper edge of the raised portions 31 of the cover 10 and with the handles 34, as by means of screws 40 engaged with integrally molded bosses 42 on the handle members 34, with the leaf springs extending into the apertures 33. The upper end portion of each of the leaf springs 38 is connected with the appropriate one of the end panels 22 and 24 by appropriate fastening means such as rivets 44. The handles 34 therefore are generally outside the panels 22 and 24, with the leaf spring 38 generally inside and exposed through the aperture 33. The handles 34 are further provided with finger recess grip portions 46 by which the user may, as shown in FIG. 2, pull the handles 34 generally outwardly so that the tongue members or paddle portions 36 thereof are generally withdrawn from the interior of the case cover 10, generally through the slots 35, and such action together with the clearance provided by the raised portions 31 will enable the carrying case covers 10 to be substantially nested and stacked for shipping and storage. Such a pull on the handles 34 also will enable the carrying case cover 10 to be lowered to cover a sewing machine, as shown, whereby the inwardly directed tongue members or paddle portions 36 can enter indents 50 or 50', for example, to clear the bed and bed cover 14 of a flat bed machine 12 as shown in FIG. 2 or the platform bed or frame cover 14' of a platform bed free arm sewing machine 12', as shown in FIGS. 3 though 5. Inwardly directed generally semi-circular ribs 48 may also be provided generally adjacent the side of the leaf springs 38, as shown, to prevent the leaf spring 38 from scratching the bed cover 14 or platform bed cover 14' as the carrying case cover 10 is lowered into the position. When the carrying case cover 10 is in position, if the handles 32 have been released, the leaf spring 38 will pull the handles 32 inwardly extending the inwardly directed tongue members or paddles 36 thereof generally beneath the sewing machine 12 or 12' and, more particularly, into the indents 50 and 50' provided, respectively, in the bed cover 14 and in the platform bed or frame cover 14'. The distal end portions of the paddles or inwardly directed tongue members 36 may further be provided with generally upwardly extending locking ribs 52 serving to aid in retaining the paddles 36 within the indents 50 and 50' and with ears 51 which will abut the raised portions 31 of the cover 10 during outward movement of the latches to limit such outward movement. Padded feet 53 are also provided.

For further disclosure of the bed cover 14, reference may be had to U.S. Design Appl. Ser. No. filed on or about June 12, 1979 by Newman and Kneipp, executed June 11, 1979, and incorporated herein by reference. The platform bed sewing machine 12' is, within the bed cover 14' provided with a supporting and stiffening frame comprising a pair of longitudinally extending ribs 54 attached to the bed and bed cover, as by means of screws 56. At either end portion of the platform bed portion 14', a transverse strap 58 is connected with the ribs 54, as by means of screws 60. The transverse straps 58 are pierced, as indicated at 62 to provide generally upwardly and inwardly extending ribs 64 against which the paddles 36 and, particularly, the ribs 52 thereof may engage so that, in carrying, the weight of the machine 12' is supported by the metal frame work comprising the ribs 54 and transverse members 58.

It is to be expressly understood that the invention is by no means limited to the forms of embodiment described and illustrated, which have been by way of example only. In particular, it comprises all the means constituting technical equivalence to means described as well as their combinations, should the latter be carried out according to the spirit of the invention.

We claim:

1. In combination with a generally open bottomed cover provided with a carrying handle for a sewing machine, a latch having a handle portion suspended from the cover by a leaf spring biasing the handle portion generally inwardly of such cover, a finger grip portion for enabling a user to pull the latch outwardly against the biasing of said leaf spring, and an inwardly directed paddle portion adapted to be moved by said leaf spring to a position extending into the open end of the carrying case cover whereat it may be engaged generally beneath a sewing machine bed, frame, bed frame or bed cover for enabling the machine to be lifted thereby with the cover.

2. Sewing machine cover defined in claim 1 wherein a pair of such latches are provided, upon opposite ends of the cover adjacent the lower edges thereof, so that a user may grasp both latches and simultaneously pull them both outwardly for fitting such cover over a sewing machine.

3. Sewing machine cover defined claimed in claim 2 tapered upwardly and inwardly from the bottom whereby when the latches are pulled outwardly, the bottom of the carrying case cover is generally open and unobstructed enabling a plurality of such covers to be generally nested and stacked for shipping and storage.

4. Sewing machine cover defined in claim 2 further comprising a pair of generally semi-circular protective ribs formed internally of said latch handle adjacent said leaf spring for precluding the edge of said spring from scratching the sewing machine or its bed cover.

5. Sewing machine cover defined in claim 2 wherein each of said paddles comprises a generally upstanding rib on the distal edge thereof for mating with an indent on the sewing machine bed.

6. Sewing machine cover defined in any of claims 1 through 5 in combination with a sewing machine having a bed or platform cover provided with indents for cooperating with said paddles.

* * * * *